United States Patent [19]

Schroeder

[11] Patent Number: 4,595,054

[45] Date of Patent: Jun. 17, 1986

[54] WELL LOCK HAVING RETRACTABLE NO-GO DOGS

[75] Inventor: Alan G. Schroeder, Houston, Tex.

[73] Assignee: Camco, Incorporated, Houston, Tex.

[21] Appl. No.: 736,031

[22] Filed: May 20, 1985

[51] Int. Cl.[4] ..... E21B 23/02

[52] U.S. Cl. ..... 166/217; 166/237

[58] Field of Search ..... 166/217, 216, 209, 237, 166/382; 285/2, 3, 4, 421, 138, 140, 144, 141

[56] References Cited

U.S. PATENT DOCUMENTS

| | | | |
|---|---|---|---|
| 2,887,163 | 5/1959 | McGowen, Jr. et al. | 166/217 |
| 3,507,329 | 4/1970 | Stone, Jr. | 166/217 |
| 4,161,984 | 7/1979 | Watkins | 166/217 |
| 4,457,368 | 7/1984 | Knierimen et al. | 166/217 |
| 4,522,259 | 6/1985 | Akkerman | 166/237 |
| 4,545,434 | 10/1985 | Higgins | 166/217 |

OTHER PUBLICATIONS

General catalog of 1975-76 Equipment and Services of Camco, Incorporated (p. 49).

*Primary Examiner*—Stephen J. Novosad
*Assistant Examiner*—Thuy M. Bui
*Attorney, Agent, or Firm*—Fulbright & Jaworski

[57] ABSTRACT

A well lock including a landing nipple having a locking notch and landing shoulder and a lock for setting in the nipple. The lock includes a body and at least one retractable no-go dog radially movable in the body and adapted to engage the landing shoulder and at least one locking dog radially movable in the body and adapted to lock in the locking notch. A rigid expander tube telescopically moves in the body between a running and a set position. In a running position the no-go locking dogs are cammed outwardly while the locking dogs are retracted. When the set position is reached the locking dogs are cammed outwardly and a recess is aligned with the no-go dogs for allowing them to retract. A seal is provided between the body and the expander tube for protecting the nipple from well fluid abrasion.

9 Claims, 2 Drawing Figures

70
12
10
22
34
57
54
50
52
24
38
58
56
66
28
28
29
36
18
39
32
42
30
16
40
30
44
20
64
60
26
62
11
27
14

12
10
22
50
24
34
56
58
66
28
38
18
46a
46
16
39
48a
30
30
48
40
64
26
11
27

WELL LOCK HAVING RETRACTABLE NO-GO DOGS

BACKGROUND OF THE INVENTION

It is conventional to set a well lock in a landing nipple in a tubing string in a well such as the series DB of Camco, Incorporated as disclosed in the General Catalog of 1975–76 Equipment and Services of Camco, Incorporated for supporting various well equipment. The landing nipple includes a locking notch for receiving locking dogs from the well lock and includes a landing shoulder which protrudes into the landing nipple bore for contacting a no-go shoulder on the lock for locating the lock and allowing a downward force to be applied to the lock for actuating the locking dogs outwardly into the locking notch. However, after the lock is set, any high downward force in the well bore on the lock creates an enormous force per unit area between the no-go shoulder and the landing shoulder of the nipple because of the small contact area. This creates the possibility that the landing shoulder of the nipple may be deformed and may create burrs which may tear up and damage the sealing packing of subsequent locks and well equipment and/or may deform the no-go shoulder of the nipple and the lock housing. U.S. Pat. No. 4,457,368 discloses an improved no-go shoulder by providing a shearable no-go plastic shoulder insert. However, such a plastic insert may prematurely fail. Furthermore, problems may arise in a conventional lock in that well fluids may flow outwardly through the well lock and erode and damage the nipple interior. Additionally, prior art well locks generally use a setting collet which can be engaged and deformed by upwardly moving well tools through the lock.

The present invention is directed to a well lock having retractable no-go dogs which, when the lock is set, may retract instead of deforming the nipple landing shoulder or the dogs. The present invention may also avoid the use of collets on the lock expander for reducing deformation of the expander tube in use, and may utilize a seal to prevent the flow of well fluid from eroding the well nipple.

SUMMARY

The present invention is directed to a well lock adapted to lock in a landing nipple in a well in which the nipple includes a locking notch and a landing shoulder. The lock includes a body having seal means thereon for sealing in the nipple and at least one retractable no-go dog radially movable in the body and adapted to engage the landing shoulder when extended outwardly, and at least one locking dog radially movable in the body and adapted to lock in the locking notch when extended outwardly. An expander tube is telescopically movable in the body between a running position and a set position. The expander tube includes a no-go locking shoulder for holding the no-go dog outwardly when the tube is in the running position and includes a no-go dog recess for allowing the no-go dog to retract when the expander tube is in the set position thereby avoiding damage to the landing shoulder and no-go dogs. The expander tube includes a locking dog shoulder for holding the locking dogs outwardly when the expander is in the set position and includes a locking dog recess for allowing the locking dogs to be retract when the expander tube is in the running position. Releasable locking means are provided between the body and the expander tube for releasably locking the tube in both the running and set position.

A still further object of the present invention is the provision of seal means between the body and the expander tube for reducing flow of abrasive well fluids through the well lock to the nipple.

Still a further object of the present invention is wherein the expander tube is a rigid tube for preventing well tools from deforming the tube. Preferably the bottom end of the tube abuts a shoulder on the body in the set position for reducing fluid flow between the expander and the body.

Still a further object of the present invention is wherein the locking dog shoulder and locking dog recess includes spaced first and second shoulders and spaced first and second recesses for reducing the cocking action as the locking dog is set.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

Figure 1:
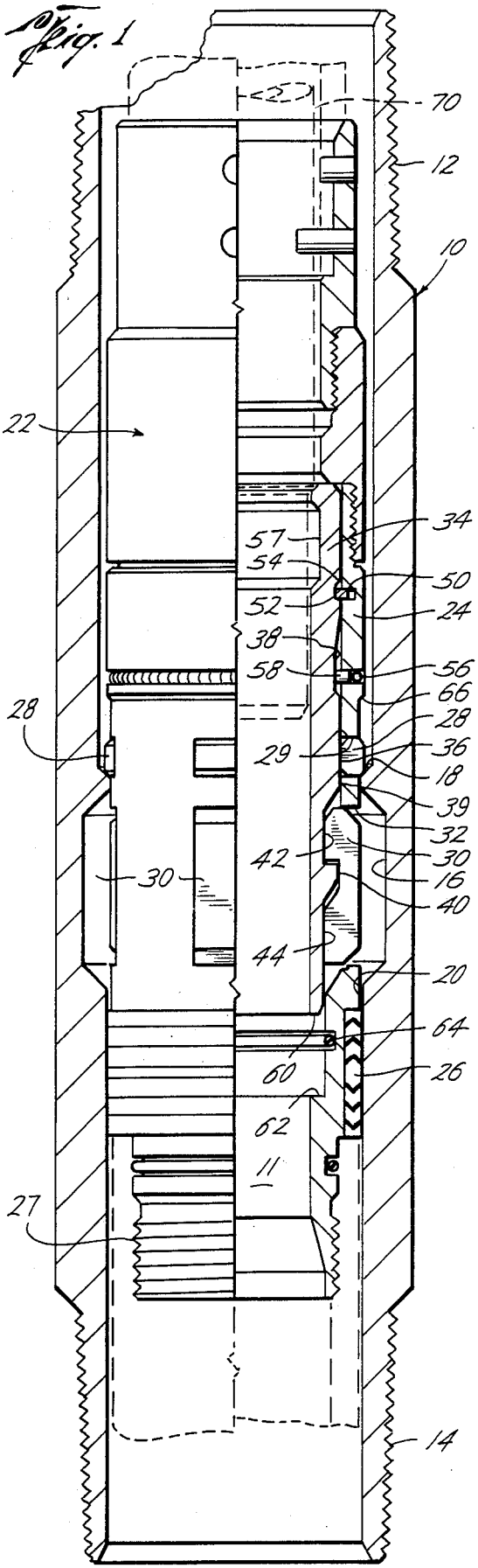
FIG. 1 is a fragmentary elevational view, in cross section, of the well lock of the present invention shown in the running position.

Referring now to the drawings, the reference numeral 10 generally indicates a landing nipple having connecting threads 12 and 14 at the top and bottom, respectively, for connection in a well production tubing in a well. The landing nipple 10 includes a locking notch 16 for receiving locking dogs of a lock, a landing shoulder 18 for engaging a no-go on a well lock for stopping the downward movement of a well lock through the nipple 10, and a polished bore 20 for coacting with a packing seal on a well lock.

The well lock, generally indicated by the reference numeral 22, includes a housing or body 24 having a seal 26 thereon for sealing against the polished section 20 of the nipple 10 and threads 27 for supporting well equipment such as a flow control. At least one and preferably a plurality of retractable no-go dogs 28 are radially movable in windows 29 in the body 24 and when extended outwardly are adapted to engage the landing shoulder 18. At least one and preferably a plurality of locking dogs 30 are radially movable in windows 32 in the body 24 and when extended outwardly are adapted to lock in the locking notch 16 of the nipple 10. The locking dogs 30 extend outwardly further than the no-go dogs 28 and thus provide a greater bearing area with the nipple 10 and are long enough to avoid being set accidentally in any collar recess above the nipple 10. The no-go dogs 28 do not extend far enough outwardly to set in a collar recess.

Figure 2:
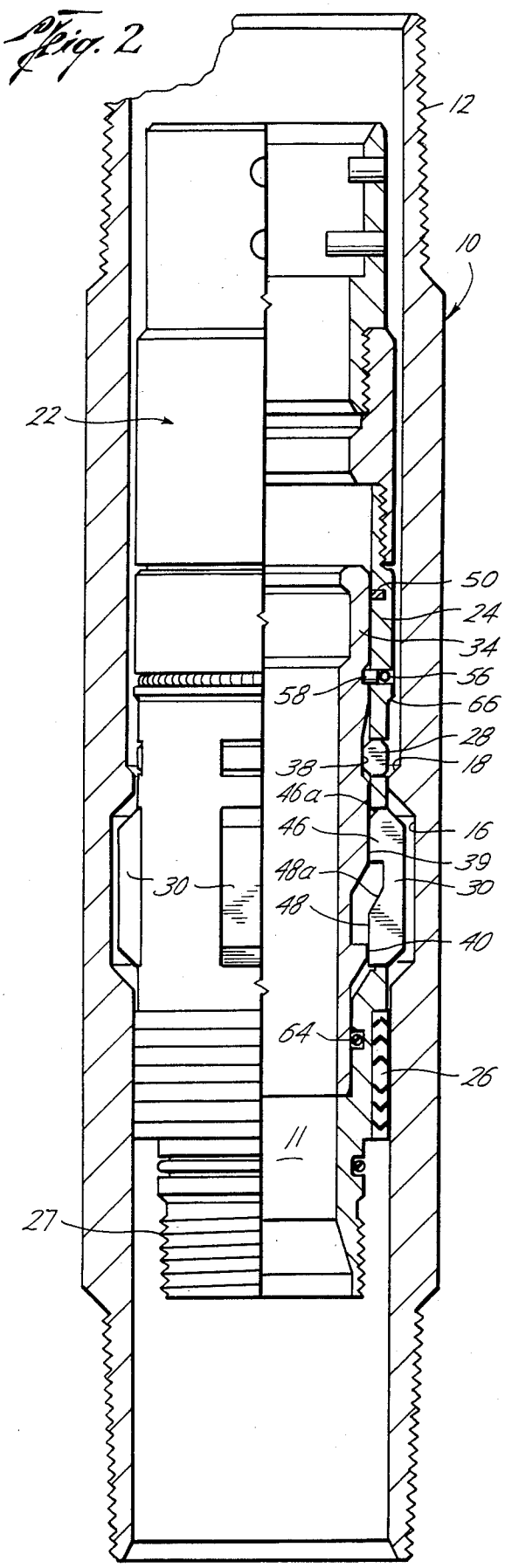
FIG. 2 is a view similar to FIG. 1 showing the well lock in the set or locked position.

An expander tube 34 is telescopically movable in the body 24 between a running position (FIG. 1) and a set position (FIG. 2). The expander tube 34 includes a no-go dog locking shoulder 36 for holding the no-go dog 28 outwardly when the expander tube 34 is in the running position (FIG. 1) for engaging and holding the dog 28 outwardly. The expander tube also includes a no-go dog recess 38 which is positioned in registry with the dogs 28 when the expander tube 34 is in the set position (FIG. 2) for allowing the dogs 28 to retract into the recess 38 and away from the landing shoulder 18. Therefore, while the no-go dogs 28 initially engage the landing shoulder 18 for holding the body 24 in position while the expander tube 34 is moved downwardly from the running position to the setting position, the no-go dogs 28, after the locking dogs 30 are set, are no longer subjected to downwardly directed pressure forces acting upon the well lock 22 which will deform either the no-go dogs 28 nor the landing shoulder 18.

The expander tube 34 also includes a locking dog shoulder and preferably first and second spaced locking dog shoulders 39 and 40 for holding the locking dog 30 outwardly when the expander 34 is in the set position. The expander tube 34 also includes a locking dog recess and preferably first and second spaced locking dog recesses 42 and 44 for allowing the locking dogs 30 be retracted into when the expander tube 34 is in the running position (FIG. 1). The locking dogs 30 include coacting surfaces 46 and 48, which include bevel surfaces 46*a* and 48*a*, respectively, which coact with the shoulders 39 and 40, which include bevel surfaces 39*a* and 40*a*, respectively, and with the recesses 42 and 44, respectively. These particular shoulders, bevels and recesses insure that the locking dogs 30 do not cock or tilt when being expanded and improperly lock in the locking notch 16.

Suitable releasable locking means are provided between the body 24 and the expander tube 34 for releasably locking the tubes 34 in both the running and set position. Thus, in the running position a snap ring 50 may be provided in the body 24 for releasably engaging an opening 52 having a beveled shoulder 54. Thus, the snap ring 50 holds the expander tube 34 in the upward or running position but allows the expander 34 to be moved downwardly into the set position at which time a garter spring 56 actuates shear pins 58 to engage the opening 52 for holding the expander tube 34 in the set position. In retrieving the well lock 22 an upward pull on the tube 34 will shear the pin 58 allowing the tube 34 to move to the upward position and release the locking dogs 30.

In the prior art locks in which the expander tube is a collet, well fluid flowing in the bore 11 could pass between the collet and the body and out the dog windows and cause abrasion and damage the interior profile of the nipple 10. The present well lock 22 restricts the flow of well fluids from the bore 11 to the interior of the nipple 10. First the lower end 60 of the expander tube abuts a shoulder 62 on the body 24 in the set position to shield the dogs 28 and 30 from fluid flow. Secondly, a seal 64 positioned between the tube 34 and the body 24 blocks upwardly flowing well fluids from the nipple 10 profile.

Another advantage of the expander tube 34 over a conventional collet type expander is that the expander 34 is a rigid tubular member and unlike collets is not subject to as much deformation as a collet in manufacture or by engaging well tools moving up the bore. In addition, the tubular expander 34 reduces manufacturing costs as compared to collets.

In addition, a permanent no-go shoulder 66 may be provided on the exterior of the body 24 for preventing the well tool 22 from becoming lost downhole in the well tubing. Shoulder 66 is positioned above the bottom of locking dogs 30 so that shoulder 62 does not engage no-go shoulder 18 in normal operation. However, in the event dogs 28 and 30 are both disengaged from the nipple 10, the shoulder 66 will engage shoulder 18 and prevent the lock 22 from passing through the nipple 10.

In the prior art the area of contact between a conventional no-go shoulder on a conventional 4½ inch DB type lock and the landing shoulder in the nipple is only 0.25 square inches. With this small area of contact, only a small downward force on the well tool is required to damage or deform the landing shoulder in the nipple or the no-go shoulder on the dog. After the present well lock 22 is in the set position any further downward force allows the beveled landing shoulder 18 to move the no-go dogs 28 into the recesses 38 instead of causing damage to the landing shoulder 18 or the dogs 28.

In order to actuate the well lock 20 any suitable setting tool may be used such as a Z-6 running tool sold by Camco, Incorporated and described and shown in U.S. Pat. No. 4,457,368. The well lock 22 can be pulled by conventional pulling tool such as a PRS tool sold by Camco, Incorporated which grips the recess 57 for removing the expander tube 34 from behind the locking dogs 30. In FIG. 1, the well lock 22 is run downhole through the well tubing and landing nipple 10 by a setting tool 70 shown in dotted outline in FIG. 1. When the retractable no-go dogs 28 engage the landing shoulder 18 the retracted locking dogs 30 are aligned with the locking notch 16. Further downward movement of the setting tool by jarring will move the expander tube 34 downwardly causing the locking shoulders 39 and 40 to move downwardly and engage the dog surfaces 46 and 48 and actuate the locking dogs 30 outwardly to the setting position in the locking notch 16 as best seen in FIG. 2. In the setting position the releasable locking means consisting of the garter spring 56 and pins 58 hold the expander tube 34 in the set position. It is also noted that in the set position the recess 36 is aligned with the no-go dogs 28 so that any further downward movement on the well lock 22 will retract the dogs 28 instead of force them against the landing shoulder 18. In laboratory tests the well lock of the present invention was able to withstand a 5,000 pound pressure differential from both above and below and inspection of the parts indicated that no measured deformation occurred in either the lock 22 or test nipple 10.

While the landing shoulder 18 and no-go dogs 28 are shown as positioned above the locking notch 16 and locking dogs 30, respectively, the nipple 10 and well lock 22 may be designed to position the landing shoulder 18 and dogs 28 below the notch 16 and dogs 30.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A well lock adapted to lock in a landing nipple in a well in which the nipple includes a locking notch and a landing shoulder comprising, a body having seal means thereon for sealing in the nipple, at least one retractable no-go dog radially movable in the body and adapted to engage the landing shoulder when extended outwardly, at least one locking dog radially movable in the body and adapted to lock in the locking notch when extended outwardly, an expander tube telescopically movable in the body between a running position and a set position, said expander tube including a no-go dog locking shoulder for holding the no-go dogs outwardly when the tube is in the running position and including a no-go dog recess for allowing the no-go dogs to retract when the expander tube is in the set position, said expander tube including a locking dog shoulder for holding the locking dogs outwardly when the expander is in the set position, and including a locking dog recess for allowing the locking dogs to retract when the expander tube is in the running position, releasable locking means between the body and the expander tube for releasably locking the tube in the running and set positions.

2. The apparatus of claim 1 including, seal means between the body and the expander tube for reducing flow of well fluids to the nipple.

3. The apparatus of claim 1 including, said locking dogs extending outwardly a greater distance than the no-go dogs extend outwardly when the locking dogs and the no-go dogs are extended.

4. The apparatus of claim 1 wherein the expander tube is a rigid tube for preventing well tools deforming said tube.

5. The apparatus of claim 4 wherein said tube abuts a shoulder on the body in the set position.

6. The apparatus of claim 1 wherein the locking dog shoulder and locking dog recess includes spaced shoulders and spaced recesses for reducing the cocking action as the locking dogs are set.

7. The apparatus of claim 1 wherein the no-go dogs are positioned above the locking dogs.

8. The apparatus of claim 1 including, a fixed no-go shoulder on the body positioned for preventing the lock from passing through the landing nipple by engaging the landing shoulder.

9. A well lock comprising, a landing nipple for use in a well conduit including a locking notch and a landing shoulder, a lock including, a body having seal means thereon for sealing in the nipple, at least one retractable no-go dog radially movable in the body and adapted to engage the landing shoulder when the no-go dog is extended outwardly, at least one locking dog radially movable in the body and adapted to lock in the locking notch when extended outwardly, an expander tube telescopically movable in the body between a running position and a set position, said expander including a no-go dog locking shoulder for holding the no-go dog outwardly when the tube is in the running position and including a no-go dog recess for allowing the no-go dog to retract when the tube is in the set position, said expander tube including first and second spaced locking dog shoulders for holding the locking dog outwardly when the expander is in the set position, and including first and second spaced locking dog recesses for allowing the locking dogs to retract when the expander tube is in the running position, said means between the body and the expander tube for reducing flow of well fluid to the nipple, and releasable locking means between the body and the expander tube for releasably locking the tube in the running and set positions.

* * * * *